US009434487B2

(12) United States Patent
Bassani

(10) Patent No.: US 9,434,487 B2
(45) Date of Patent: Sep. 6, 2016

(54) CONTAINER FILLING MACHINE

(75) Inventor: Loris Bassani, Montreal (CA)

(73) Assignee: COUNTLAB, INC, Montreal, Quebec (CA)

( * ) Notice: Subject to any disclaimer, the term of this patent is extended or adjusted under 35 U.S.C. 154(b) by 1143 days.

(21) Appl. No.: 13/249,780

(22) Filed: Sep. 30, 2011

(65) Prior Publication Data

US 2013/0081737 A1 Apr. 4, 2013

(51) Int. Cl.

| | |
|---|---|
| ***B65B 1/04*** | (2006.01) |
| ***B65B 1/28*** | (2006.01) |
| ***B65B 43/42*** | (2006.01) |
| ***B65B 1/06*** | (2006.01) |
| ***B65B 1/46*** | (2006.01) |

(52) U.S. Cl.

CPC . *B65B 1/28* (2013.01); *B65B 1/06* (2013.01); *B65B 1/46* (2013.01); *B65B 43/42* (2013.01)

(58) Field of Classification Search

CPC ..... B65B 1/28
USPC ..... 141/129–191, 65
See application file for complete search history.

(56) References Cited

U.S. PATENT DOCUMENTS

| | | | | |
|---|---|---|---|---|
| 4,146,123 | A | 3/1979 | Cottrell | |
| 5,558,199 | A | 9/1996 | Roether et al. | |
| 6,631,799 | B2 | 10/2003 | Samson | |
| 7,086,522 | B2 | 8/2006 | Schmidt | |
| 7,956,623 | B2 | 6/2011 | Bassani et al. | |
| 7,980,277 | B2 * | 7/2011 | Amano | 141/83 |
| 8,225,925 | B2 | 7/2012 | Bassani | |
| 2002/0139436 | A1 * | 10/2002 | Rosen et al. | 141/86 |
| 2003/0217783 | A1 * | 11/2003 | Harris | B01J 8/004 141/67 |
| 2010/0115888 | A1 | 5/2010 | Bassani et al. | |

FOREIGN PATENT DOCUMENTS

| | | | |
|---|---|---|---|
| CA | 2 060 784 | A1 | 8/1992 |
| CA | 2 321 725 | C | 7/2004 |
| DE | 41 18 878 | A1 | 1/1993 |
| DE | 43 31 879 | A1 | 3/1994 |
| DE | 20 2004 008 975 | U1 | 9/2004 |
| DE | 10 2004 027 590 | B3 | 11/2005 |
| EP | 1 431 181 | A1 | 6/2004 |
| EP | 1 481 913 | A1 | 12/2004 |
| EP | 1 431 182 | B1 | 6/2006 |

(Continued)

OTHER PUBLICATIONS

Office Action issued Dec. 7, 2011 in connection with U.S. Appl. No. 12/628,740, 5 pages.

*Primary Examiner* — Jason K Niesz

(57) ABSTRACT

A container filling machine comprising a container engaging device, a suction device for suctioning fine airborne particles and a container removing device for removing defective containers from continued travel along a production line. The suction device comprises a discrete article guiding passage for guiding discrete articles into a container. The discrete article guiding passage comprises a passageway having a length through which discrete articles pass prior to entering the container and at least one suction aperture into which airborne particles are sucked. The at least one suction aperture is positioned at a region along the length of the passageway. The suction device further comprises a suction pump in communication with the discrete article guiding passage for creating a suction effect for sucking airborne particles into the at least one suction aperture.

8 Claims, 10 Drawing Sheets

(56) References Cited

FOREIGN PATENT DOCUMENTS

| | | | |
|---|---|---|---|
| EP | 1 602 593 | B1 | 8/2006 |
| EP | 1 471 993 | B1 | 1/2007 |
| EP | 1 588 944 | B1 | 9/2009 |
| GB | 2 270 771 | A | 3/1994 |
| GB | 2 310 729 | A | 9/1997 |
| GB | 2 326 488 | A | 12/1998 |
| JP | 1210200 | A | 8/1989 |
| JP | 4352669 | A | 12/1992 |
| JP | 5228447 | A | 9/1993 |
| JP | 6032347 | A | 2/1994 |
| JP | 2000079912 | A | 3/2000 |
| JP | 2002249103 | A | 9/2002 |
| WO | 95-25333 | A1 | 9/1995 |

* cited by examiner

CONTAINER FILLING MACHINE

FIELD OF THE INVENTION

The present invention relates generally to the field of container filling machines for filling containers with discrete articles, and specifically to container filling machines capable of being adjusted to accommodate containers of different shapes and sizes.

BACKGROUND OF THE INVENTION

Container filling machines for filling containers with discrete articles (such as pharmaceutical pills, cosmetic items, hardware components, candies, nuts, etc. . . . ) are known in the art. Such container filling machines are able to take a large supply of discrete articles and transport them towards one or more containers, for filling those containers with a precise number of discrete articles. However, existing container filling machines are plagued with numerous deficiencies that often render them ineffective and inefficient. This is detrimental in a field where the speed, accuracy and durability of the machines are desirable.

A known deficiency with existing container filling machines is that they are not always able to properly support and stabilize the containers as the containers are moving in relation to the container filling machine. This can cause the containers to tip over or be badly positioned in relation to the dispensers of the discrete articles. This lack of proper support and positioning can cause interruptions and slowdowns in the functioning of the container filling machine. Furthermore, existing container filling machines do not provide any form of adjustable support or stability in order to accommodate containers of different shapes and sizes. As such, traditional container filling machines are not particularly versatile when it comes to handling containers of different shapes and sizes.

Container filling machines are often used to fill containers containing pharmaceutical discrete articles, such as pressed powder pills. When handling discrete articles that are made of pressed powder, a relatively significant amount of dust and fine airborne particles is created. A deficiency with existing container filling machines is that this dust accumulates within the components of the container filling machines, thus requiring frequent maintenance and cleaning of the machines.

Furthermore, when filling containers with discrete articles, there is always the chance that one of the containers will be defective, meaning that the container is damaged in some way or has been filled with an inappropriate number of discrete articles, among other possibilities. In such cases, the defective container needs to be removed from continued travel along the production line in order to maintain quality control standards. Many existing container filling machines do not have fast and efficient ways of detecting and removing defective containers from continued travel along the production line.

In light of the above, it is clear that there is a need in the industry for an improved container filling machine that alleviates, at least in part, the deficiencies of existing container filling machines, and provides more versatility in being able to process containers of different shapes and sizes.

SUMMARY OF THE INVENTION

In accordance with a first broad aspect, the present invention comprises an assembly for use with a container filling machine. The assembly comprises a container engaging device for receiving at least one container to be filled by the container filling machine. The container engaging device stabilizes the at least one container as the at least one container moves in relation to the container filling machine along a transporting path. The assembly further comprises a control entity for receiving input information on a basis of which a suitable position for the container engaging device in relation to the transporting path can be determined. The suitable position is a position in which the container engaging device is able to stabilize the at least one container to be filled as the at least one container moves in relation to the container filling machine. The control entity further determines, at least in part on a basis of the input information, the suitable position for the container engaging device and causes the container engaging device to acquire the suitable position in relation to the transporting path.

In accordance with a second broad aspect, the present invention comprises a method for adjusting a position of a container engaging device of a container filling machine. The container engaging device stabilizes at least one container as the at least one container moves in relation to the container filling machine along a transporting path. The method comprises receiving, at a control entity, input information on a basis of which a suitable position for the container engaging device in relation to the transporting path can be determined. The suitable position is a position in which the container engaging device is able to stabilize the at least one container to be filled as the at least one container moves in relation to the container filling machine. The method further comprises, determining at the control entity at least in part on a basis of the input information, the suitable position for the container engaging device and causing the container engaging device to acquire the suitable position in relation to the transporting path.

In accordance with a third broad aspect, the present invention comprises a container filling machine for filling a container with discrete articles, the container filling machine comprising a discrete article guiding passage for guiding discrete articles into the container. The discrete article guiding passage comprises a passageway having a length through which discrete articles pass prior to entering the container and at least one suction aperture positioned at a region along the length of the passageway into which airborne particles that enter the passageway are sucked.

In accordance with a fourth broad aspect, the present invention comprises a suction device for use with a container filling machine. The suction device comprises a discrete article guiding passage for guiding discrete articles into the container. The discrete article guiding passage comprises a passageway having a length through which discrete articles pass prior to entering the container and at least one suction aperture into which airborne particles that enter the passageway are sucked. The at least one suction aperture is positioned at a region along the length of the passageway. The suction device further comprises a suction pump in communication with the discrete article guiding passage for creating a suction effect for sucking airborne particles into the at least one suction aperture.

In accordance with a fifth broad aspect, the present invention comprises a method for removing a container from continued travel along a production line. The method comprising receiving a signal indicative that a container that has been filled by a container filling machine is a defective container, causing a container removing device to establish suction engagement with the defective container while the defective container is in contact with a container engaging device of a container filling machine, causing the defective container to be carried, via the suction engagement, to a drop-off position wherein the defective container is released from suction engagement, wherein at the drop-off position the defective container has been removed from continued travel along the production line and receiving a signal confirming that the defective container has been released at the drop-off position.

In accordance with a sixth broad aspect, the present invention comprises an assembly for use with a container filling machine, comprising a feed screw for supporting at least one container as the at least one container is being filled by the container filling machine, the feed screw comprising a set of indents for contacting a side portion of the at least one container. The assembly further comprising a container removing device comprising a plurality of container engaging recesses, wherein at least one of the plurality of container engaging recesses is in contact with the at least one container while the container is in contact with the feed screw, and a control entity for determining whether the at least one container is a defective container and upon determination that the at least one container is a defective container, causing the container removing device to establish suction engagement with the defective container while the defective container is in contact with the feed screw for carrying the defective container to a drop-off position wherein the defective container is released from suction engagement with the container removing device. At the drop-off position the defective container has been removed from continued travel along the production line.

Other aspects and features of the present invention will become apparent to those ordinarily skilled in the art upon review of the following description of specific embodiments of the invention in conjunction with the accompanying figures.

DETAILED DESCRIPTION

Figure 1:
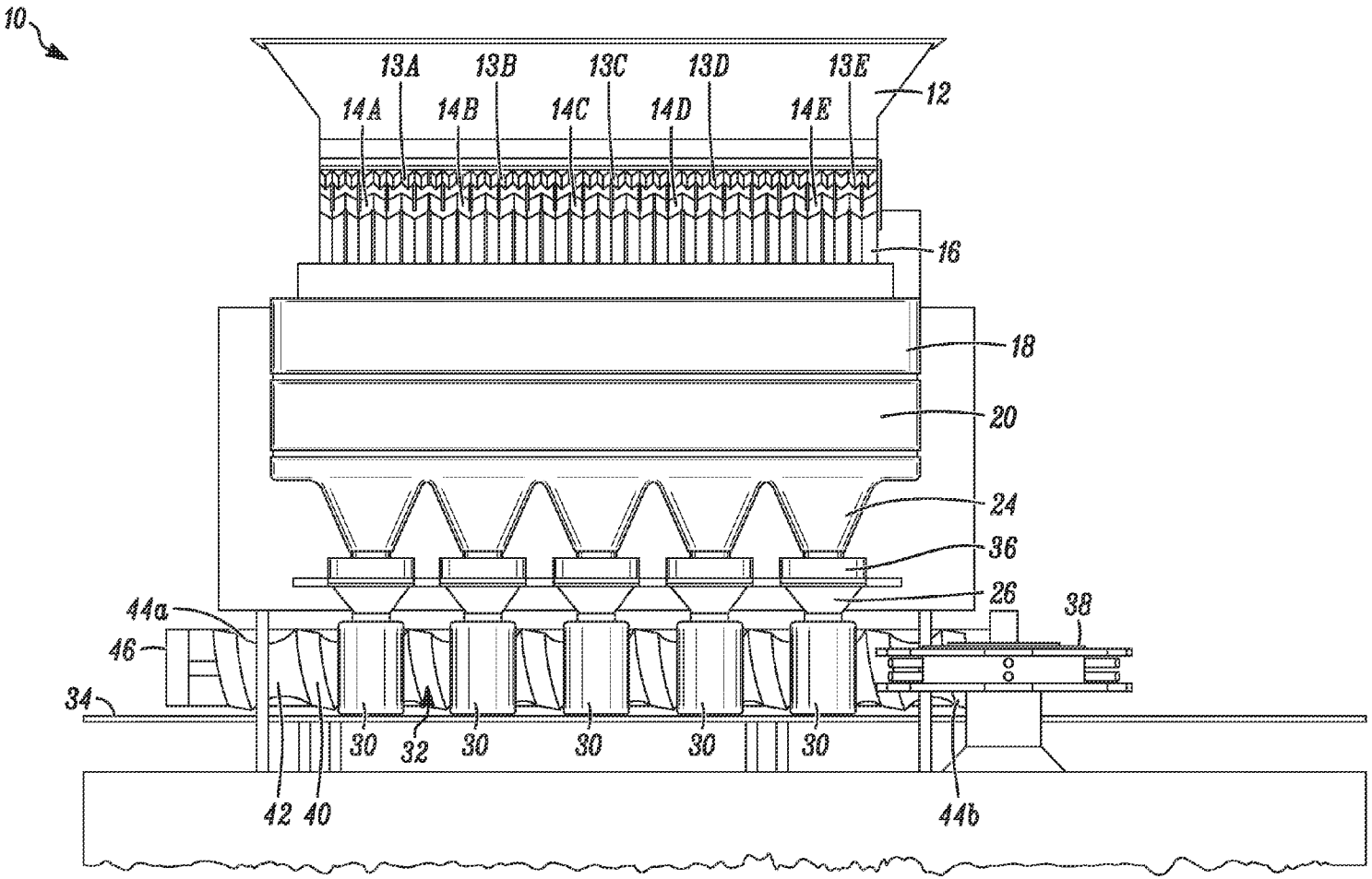
FIG. 1 shows a front plan view of a container filling machine in accordance with a non-limiting example of implementation of the present invention.

Shown in FIG. 1 is a front view of a container-filling machine 10 in accordance with a non-limiting example of implementation of the present invention. The container filling machine 10 is suitable for loading discrete articles into containers, such as discrete articles for personal treatment (e.g. pharmaceutical pills, cosmetic items, etc) or candies, nuts, or any other type of discrete article. As used herein, the term "discrete article for personal treatment" includes any type of pharmaceutical discrete article that may be ingested (such as pressed-powder or gel cap pills, among other possibilities) as well as any cosmetic item that may be applied to an external part of the body (such as moisturizer capsules, for example).

In the non-limiting embodiment shown, the container filling machine 10 includes a discrete article dispensing device 12, guiding trays 13*a*-13*e*, vibration trays 14*a*-14*e*, and a plurality of guiding paths 16 that lead the discrete article past a sensing device, a rejection device and a counting device, which are hidden behind the front plate 18, in the embodiment shown in FIG. 1. A more detailed description of a possible sensing device, rejection device and counting device that can be used with the container filling machine 10 of the present invention is described in U.S. Pat. No. 7,956,623, and as such will not be described in more detail herein. The guiding paths 16 eventually lead into a set of discrete article guiding passages 26 that dispense the discrete articles into respective containers 30.

In operation, the discrete articles travel through the container filling machine 10 in order to be placed into the containers 30. Initially, a load of discrete articles is placed within the discrete article dispensing device 12, which then deposits the discrete articles onto the guiding trays 13*a*-13*e*. The guiding trays 13*a*-13*e* move the discrete articles forward via vibrational motion, while causing the discrete articles to become spaced from one another as they travel towards the vibration trays 14*a*-14*e*. Once the discrete articles reach the vibration trays 14*a*-14*e*, the vibration trays 14*a*-14*e* continue to carry the discrete articles towards the guiding paths 16 via vibrational motion, and create further spacing between the discrete articles. The discrete articles then slide down the guiding paths 16 through a sensing device (not shown), which senses whether or not the discrete articles are defective, a rejection device (not shown), which may remove any defective ones of the discrete articles from continued travel along the guiding paths 16, and a counting device (not shown) for obtaining a count of the number of discrete articles that pass along each guiding path 16. More specifically, the counting device counts the discrete articles before they enter the discrete article guiding passages 26 which dispense the discrete articles into respective ones of the containers 30. The container filling machine 10 shown in FIG. 1 may further comprise path blocking devices (not shown) positioned prior to the discrete article guiding passages 26 that are operative for temporarily stopping the discrete articles from passing into the discrete article guiding passages 26 while the containers 30 are being changed. As mentioned above, such a sensing device, rejection device, counting device and path blocking devices are described in more detail in issued U.S. Pat. No. 7,956,623 having the same inventor.

Figure 2:
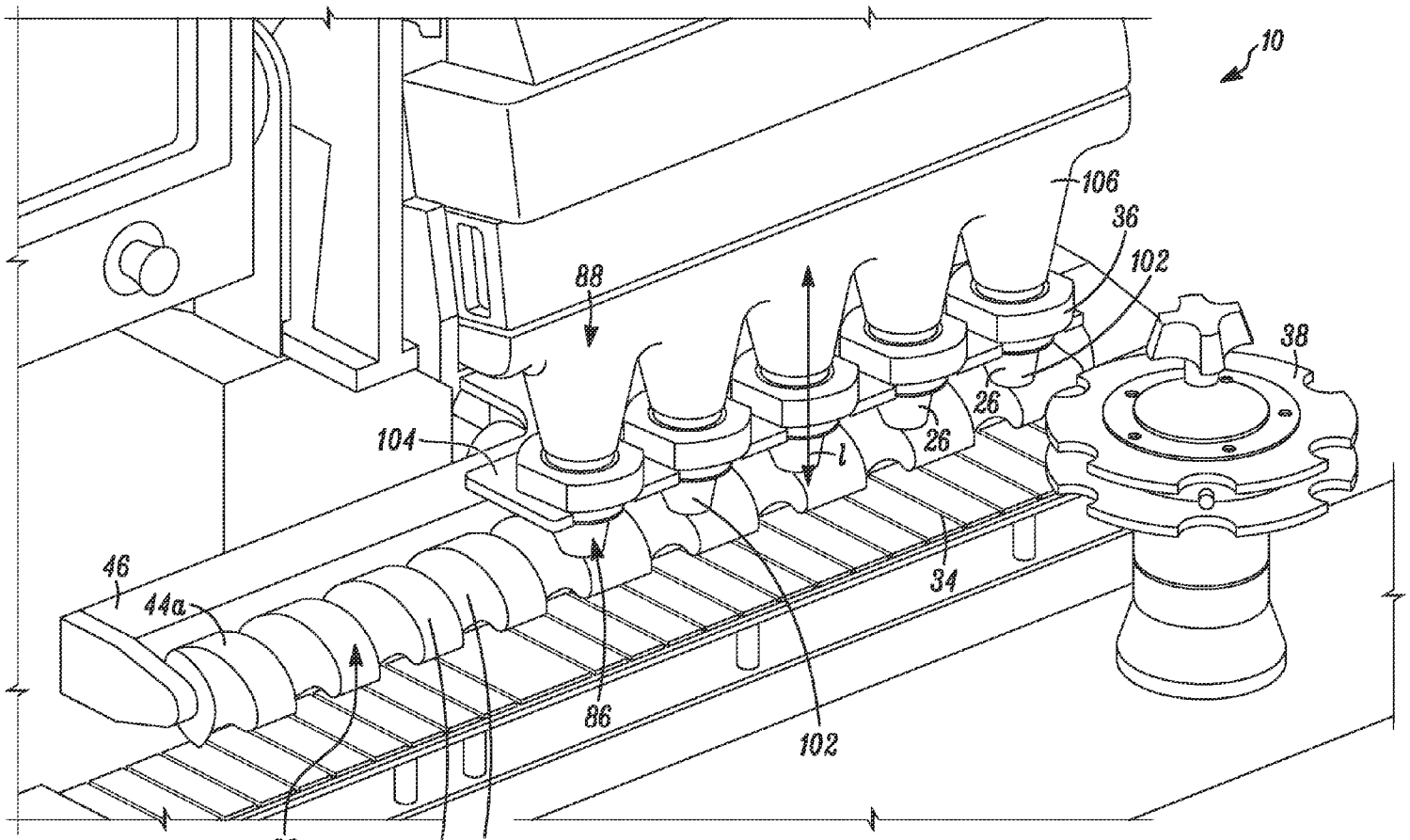
FIG. 2 shows a side perspective view of a bottom portion of the container filling machine of FIG. 1, showing a container engaging device, discrete article guiding passages and a container removing device according to non-limiting examples of implementation of the present invention.

Shown in FIG. 2 is an expanded perspective view of the lower portion of the container filling machine 10 of FIG. 1. FIG. 2 shows a container engaging device 32 that supports and stabilizes the containers 30 as the containers 30 travel along a transporting path 34 in relation to the container filling machine 10. FIG. 2 also shows a set of discrete article guiding passages 26 according to the present invention, that each comprise one or more suction apertures that are in communication with a suction pump such that fine airborne particles that enter the guiding passages 26, such as dust particles generated by the discrete articles, are suctioned out of the discrete article guiding passages 26 and thus prevented from accumulating within the container filling machine 10. FIG. 2 further shows a container removing device 38 that is operative for establishing engagement with a defective or deficient container and removing the defective or deficient container from continued travel along the container transporting path 34 of the production line. Each of these components will be described in more detail further on in the description.

The Container Engaging Device 32

The container engaging device 32 will now be described in more detail with respect to FIGS. 2 through 5. The container engaging device 32 is adapted for supporting and stabilizing containers 30 as they move in relation to the container filling machine 10. As shown in FIG. 2, a container transporting path 34 runs underneath the discrete article guiding passages 26 for moving empty containers 30 into position beneath these discrete article guiding passages 26 and then moving the filled containers 30 away from the discrete article guiding passages 26 such that they can continue along the production line. As such, the container engaging device 32 is operative for supporting and stabilizing the containers 30 as they are moved into position underneath the discrete article guiding passages 26, as they are being filled with discrete articles, and as they are transported away from the discrete article guiding passages 26.

Figure 3:
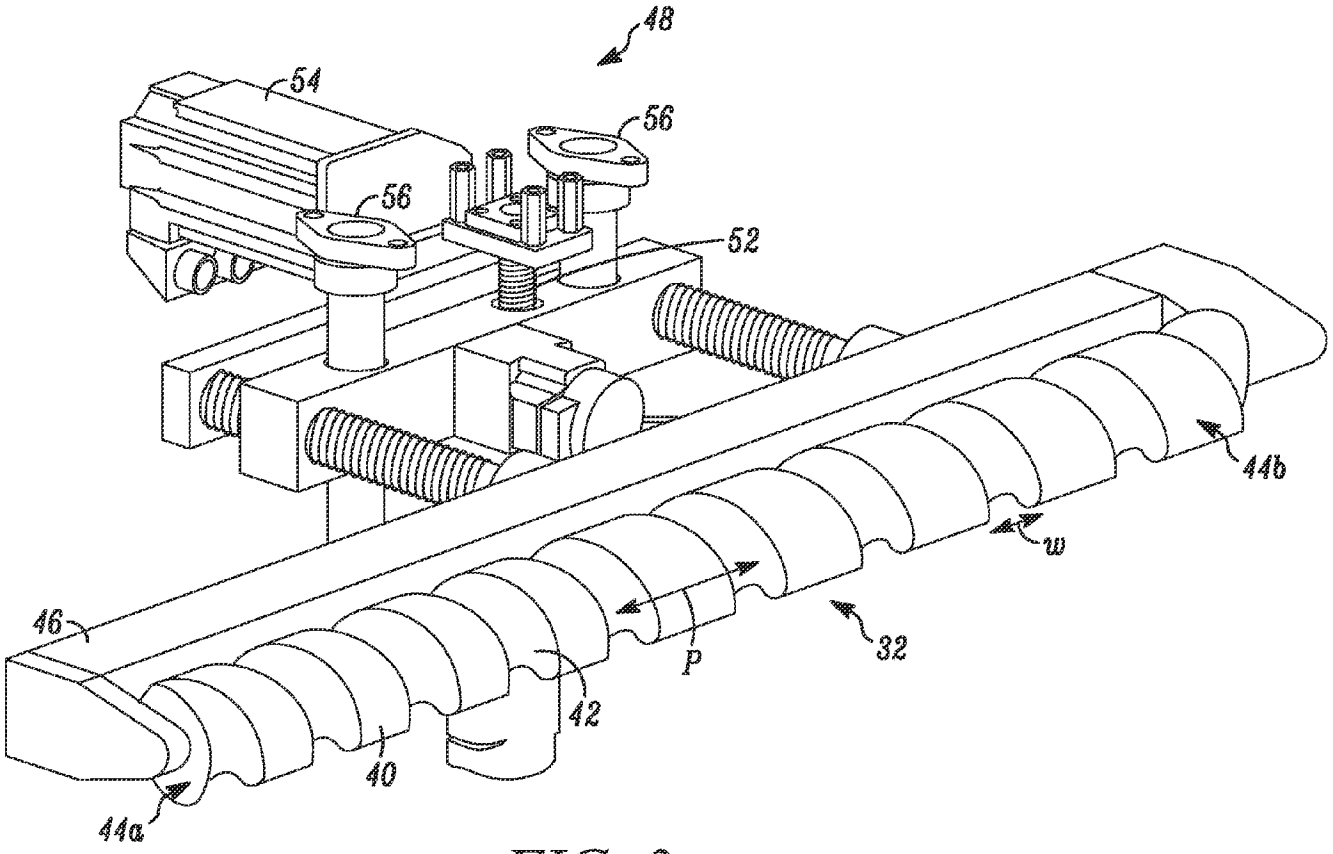
FIG. 3 shows an isolated side perspective view of the container engaging device of FIG. 2.

In the non-limiting embodiment shown, the container engaging device 32 comprises a feed screw 40. The feed screw 40 is substantially cylindrical in shape with a helical shaped groove 42 indented therein. As shown in FIG. 3, the helical shaped groove 42 has a width "w" that is suitable for receiving a side portion of the containers 30, and any shape that can engage the profile of the containers 30 that are being filled by the container filling machine 10. In this manner, the helical shaped groove 42 engages with a side portion of each container 30 as the containers 30 approach the container engaging device 32.

The distance or pitch "p" between each coil of the helical shaped groove 42 is approximately the same as the distance separating the centers of the discrete article guiding passages 26. Therefore, once the containers 30 are engaged within the coils of the helical shaped groove 42, the pitch "p" of the helical shaped groove 42 causes the containers 30 to be positioned beneath the discrete article guiding passages 26 such that they are positioned directly beneath respective ones of the discrete article guiding passages 26. In the embodiment shown, the container filling machine 10 comprises five discrete article guiding passages 26 for filling five containers 30 simultaneously, however, in other embodiments, it is possible for the container filling machine 10 to have more or fewer discrete article guiding passages 26 for dispensing the discrete articles.

As shown in FIGS. 2 and 3, the feed screw 40 is attached to a frame component 46 at each of its ends 44*a*, 44*b* via pins (not shown). In this manner, the feed screw 40 is able to rotate about its longitudinal axis. As the feed screw 40 rotates, an indent of the helical shaped groove 42 that has received a container 30 moves laterally in the direction of movement of the transporting path 34. In this manner, the indent of the helical shaped groove 42 that has received a container 30 is able to move with the container 30 in a longitudinal direction along the container transporting path 34.

The container engaging device 32 may be made of a variety of materials. In accordance with non-limiting examples of implementation, the container engaging device 32 can be made of metal, such as stainless steel, plastic, polyurethane or any other suitable material known in the art. In addition, the container engaging device 32 may be made of a plurality of different materials, such that the feed screw 32 is formed of plastic with metal pins (not shown) connecting the feed screw 32 to a metal frame component 46.

In accordance with a first non-limiting example of implementation, the feed screw 40 is caused to rotate by the movement of the containers 30 along the transporting path 34. In other words, the feed screw 40 is not actively rotated by a drive mechanism and is instead caused to rotate by the movement of the containers 30 along the transporting path 34.

However, in accordance with an alternative non-limiting example of implementation, the feed screw 40 is actively rotated by a drive mechanism that is in communication with the feed screw 40. More specifically, the drive mechanism may be a servo motor 54 (as shown in FIG. 3) that is in communication with the feed screw 40 for causing the rotation of the feed screw 40. In accordance with a non-limiting example, the servo motor 54 may be in communication with a belt that extends around the end of the feed screw 40 (not shown), such that as the belt is driven by the servo motor 54, the feed screw 40 is rotated.

In accordance with a non-limiting embodiment, the servo motor 54 may cause the feed screw 40 to rotate five times, which may result in five containers 30 being positioned beneath the five discrete article guiding passages 26 that dispense the discrete articles into the containers 30. It should however be understood that the servo motor 54 may cause the feed screw 40 to rotate more times, or less times, depending on factors such as the distance between the beginning of the feed screw 40 and the first discrete article guiding passages 26, and the number of containers 30 that are being filled at the same time.

Although a servo motor 54 is described above to impart rotational motion to the feed screw 40, other manners of imparting rotational motion to the feed screw 40 are also included within the scope of the present invention. In certain cases, the conveyor belt of the transporting path 34 is not stopped during the filling of the containers 30. In that case, the conveyor belt simply slides underneath the containers 30 that are held in place by the container engaging device 32. Alternatively, the conveyor belt of the transporting path 34 may be stopped when the containers 30 are being filled underneath the discrete article guiding passages 26. In such a case, the control of the rotation of the container engaging device 32 will be coordinated with the movement of the transporting path 34 such that when the transporting path 34 stops moving (such as when the containers 30 are positioned beneath the discrete article guiding passages 26 to receive the discrete articles), the rotation of the feed screw 40 also stops. In addition, the speed of rotation of the feed screw 40 will be timed such that the lateral movement of the indents of the helical shaped groove 42 travel at the same speed as the transporting path 34. This avoids the containers 30 tipping over as a result of a discrepancy in the speeds of the feed screw 40 and the transporting path 34. A control entity 60 that is operative for controlling the servo motor 54, and thus the rotation of the feed screw 40, will be described in more detail below with respect to FIG. 4.

Although in the non-limiting example of implementation described above, the container engaging device 32 is in the form of a feed screw 40 having a helical shaped groove 42 for receiving the containers 30, in alternative embodiments, the container engaging device 32 may take on many different implementations without departing from the spirit of the invention. For example, the container engaging device 32 may be in the form of a notched conveyor belt that engages the containers within the notches, among other possibilities. More specifically, each of the containers 30 may fit within one of the notches of the conveyor belt, such that the conveyor belt is able to impart stability to the containers. While a variety of different implementations for the container engaging device are possible and within the scope of the present invention, for the sake of simplicity, the container engaging device 32 will be described as being the feed screw 40 with the helical shaped groove 42 for the purposes of this description. However, any type of container engaging device 32 that is able to provide support and stability to the containers 30 as they move in relation to the container filling machine 10, is included within the scope of the present invention.

In order to provide versatility to a production line, the container filling machine 10 according to the present invention is operative for filling containers 30 of all different shapes and sizes. Often, different types of containers 30 are used for different types of discrete articles. As such, it is desirable that the container filling machine 10, and more specifically the container engaging device 32, is able to accommodate different shapes and sizes of containers 30.

In the case where the container filling machine 10 is intended to be used to process discrete articles of different shapes and sizes, it makes sense for the positioning of the container engaging device 32 to be adjustable in relation to the transporting path 34 and/or the discrete article guiding passages 26. In this manner, depending on the type of containers 30 being filled, the container engaging device 32 can be positioned such that it is best able to provide support and stability to that size and shape of container 30. Depending on the height and width of the containers 30 being filled, it may be desirable to change the positioning of the container engaging device 32 in relation to the transporting path 34 and/or in relation to the discrete article guiding passages 26. This change in positioning may cause the container engaging device 32 to move to a higher or lower position in relation to the transporting path 34 and/or the discrete article guiding passages 26, or may cause the container engaging device 32 to move forwards or backwards in relation to the transporting path 34 and/or the discrete article guiding passages 26. As such, the container engaging device 32 may be movable in a back and forth direction (parallel) or an up and down direction (perpendicular) in relation to the transporting path 34. This movement may be along any vector that has a component that is parallel to, and a component that is perpendicular to, the transporting path 34.

Shown in FIG. 3 is an isolated view of the container engaging device 32. As shown, the container engaging device 32 is in communication with a positioning assembly 48 for enabling the container engaging device 32 to be moved in relation to the transporting path 34. The positioning assembly 48 shown comprises mechanical components for enabling the up-and-down movement, as well as the back-and-forth movement, of the frame portion 46 to which the feed screw 40 is connected. In the non-limiting embodiment shown, the positioning assembly 48 comprises threaded rods 50 for enabling the back and forth movement of the frame portion 46, and a threaded rod 52 for enabling the up and down movement of the frame portion 46. However, other mechanical components for enabling the movement of the frame portion 46 may also be used, such as hydraulic or pneumatic cylinders, or gear arrangements that are able to provide horizontal and/or vertical motion to the frame portion 46. Any mechanical or electro-mechanical arrangement that is able to provide movement in one, two or three degrees of freedom is included within the scope of the present invention.

Although not shown in the Figures, the positioning assembly 48 may be mounted to, or in relation to, the container filling machine 10 in a variety of different manners. With reference to FIG. 3, the positioning assembly 48 may be mounted to the underneath of a frame or body of the container filling machine 10 via connector elements 56. Any suitable manner of attaching the positioning assembly 48 to, or in proximity to, a frame or body of the container filling machine 10 is included within the scope of the present invention.

In the non-limiting example of implementation shown in FIG. 3, the positioning assembly 48 is further in communication with servo motor 54. In the embodiment shown, the servo motor 54 is in communication with the threaded rods 50 and 52 for imparting rotational motion to the rods 50 and 52, for causing the positioning of the container engaging device 32 to be adjusted. More specifically, the servo motor 54 is able to cause the rotation of the rods 50 and 52 for causing the back-and-forth movement, and the up-and-down movement of the frame portion 46. It should be appreciated that in an alternative embodiment, separate servo motors may be used to control the movement of the individual rods 50 and 52 and the rotation of the feed screw 40.

In accordance with a non-limiting embodiment, the servo motor 54 that is operative for causing adjustment of the positioning of the container engaging device 32 is equipped with an encoder that is able to detect the exact positioning of the motor at a given point in time, by detecting a pulsation position, for example. Furthermore, the encoder enables the motor to acquire an exact position, when so instructed. This enables the motor to reliably and repeatedly position the container engaging device 32 in an exact position. Encoders for servo motors are known in the art and as such will not be described in more detail herein.

The control of the positioning of the container engaging device 32 will now be described in more detail with respect to the block diagram of FIG. 4 and the flow diagram of FIG. 5.

Figure 4:
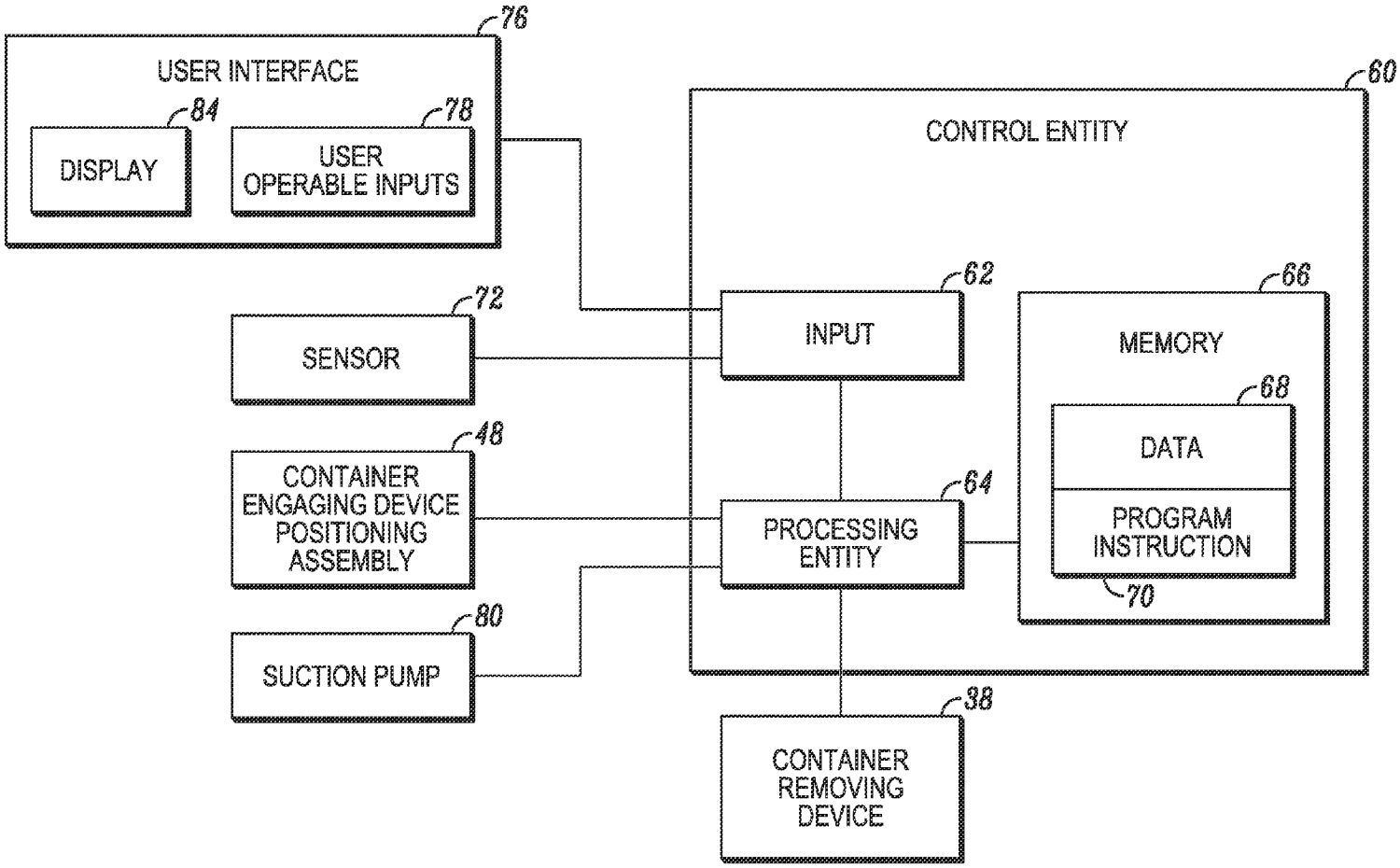
FIG. 4 shows a non-limiting block diagram of a control entity suitable for implementing at least some of the functionality of the container filling machine of the present invention.

As shown in FIG. 4, a control entity 60 is in communication with the positioning assembly 48 of the container engaging device 32, and more specifically with the servo motor 54 of the positioning assembly 48, for causing the servo motor 54 to impart motion to one or both of the rotatable rods 50, 52 (or any other mechanical components) for adjusting the position of the frame portion 46 which in turn, causes the positioning of the container engaging device 32 to be adjusted. In this manner, the container engaging device 32 can be caused to acquire a desired position in relation to the container transporting path 34 that is suitable for accommodating the shape and size of containers 30 being filled.

In the non-limiting embodiment shown, the control entity 60 comprises an input 62 for receiving information and/or commands from a user interface 76 and/or one or more sensors 72. The control entity 60 further comprises a processing entity 64 in communication with both the input 62 and a memory 66. Information that is received at the input 62 from either the sensors 72 or the user interface 76 is then passed to the processing entity 64. The memory 66 comprises data 68 and program instruction 70 that can be accessed and executed by the processing entity 64, at least in part on a basis of the information received from the user interface 76 and/or sensors 72, for implementing the functionality that will be described in more detail below. Although the data 68 and program instructions 70 are shown as being stored locally within the control entity 60, they may be stored at locations remote from the control entity 60, such as within one or more network servers that are accessible by the control entity 60.

The control entity 60 may be a dedicated control entity for controlling the positioning of the container engaging device 32, or alternatively, the control entity 60 may be in communication with other components, such as a suction pump 80 and the container removing device 38, which will be described in more detail below, for controlling the functionality of these components as well. The control entity 60 may be an integral part of the container filling machine 10, or may be a portable device such as a laptop, or desktop computer that is connected via cables to the components 48, 80 and 38. In yet a further alternative embodiment, the control entity 60 may be implemented within a portable wireless device, such as a smart phone, such that it is in communication with the various components over wireless RF or cellular connections. In yet a further example of implementation, the control entity 60 may be implemented at a remote server, such that it is in communication with the components 48, 72, 76, 80 and 38 over network connections, via the internet, or a local intranet, for example.

In accordance with a first non-limiting example of implementation, the control entity 60 is operative for adjusting the positioning of the container engaging device 32 at least in part on a basis of information entered by a user via the user interface 76. And in accordance with a second non-limiting example of implementation, the control entity 60 is operative for adjusting the positioning of the container engaging device 32 at least in part on a basis of information received from sensors 72. Each of these different scenarios will be described in more detail below.

i) Adjusting the Positioning of the Container Engaging Device 32 on a Basis of Information Entered by a User.

As mentioned above, in a non-limiting example of implementation, the control entity 60 is in communication with a user interface 76. The user interface 76 comprises user operable inputs 78 for enabling a user to provide information, such as commands, to the control entity 60. The user operable inputs 78 may be buttons, levers, toggles or any other sort of mechanical input operable by a user and known in the art. The user interface 76 may also be a graphical user interface that comprises a display screen 84. In the case of a graphical user interface, the user operable inputs 78 may include user input elements displayed on the display screen that are operable by "clicking" on the user input elements via an input device such as a mouse, a stylus pen, a touch sensitive screen or a ball mechanism, among other possibilities.

On a basis of information input by a user via the user interface 76, the control entity 60 is operative for causing an adjustment in the positioning of the container engaging device 32 such that the container engaging device 32 acquires a suitable position for stabilizing the shape and size of the containers 30 being filled. The manner in which this is done will be described in more detail with reference to the flow chart of FIG. 5.

Figure 5:
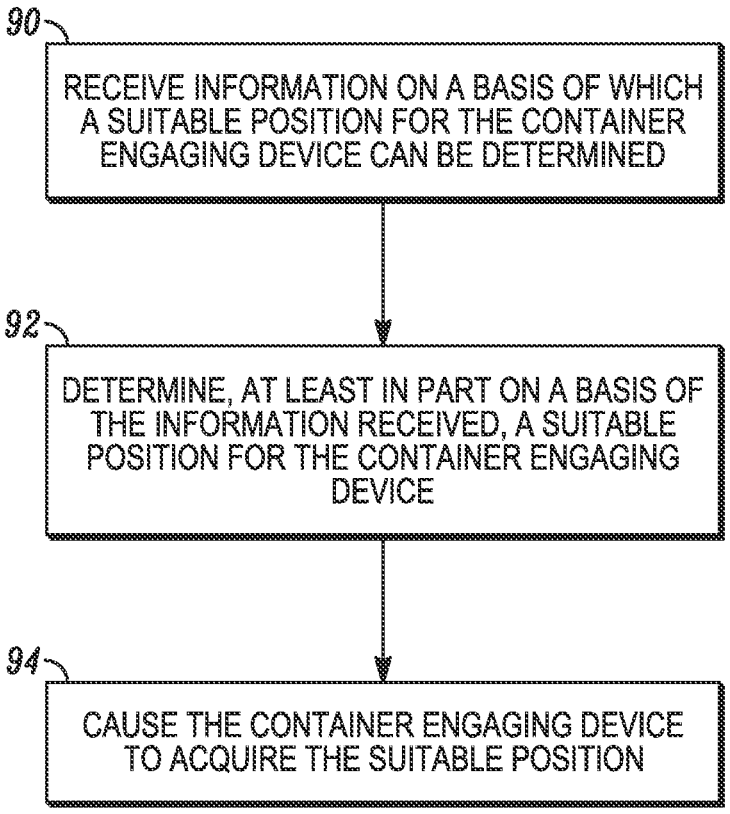
FIG. 5 shows a flow diagram of a non-limiting method of causing the container engaging device to acquire a suitable position in relation to a discrete article transporting path.

FIG. 5 shows a flow diagram of a non-limiting method for causing the adjustment in the positioning of the container engaging device 32. At step 90, the control entity 60 receives information from a user via the user interface 76 indicative of information on a basis of which a suitable position for the container engaging device 32 can be determined. The suitable position for the container engaging device 32 is generally determined in relation to the transporting path 34 along which the containers 30 move in relation to the container filling device 10. However, the suitable position for the container engaging device 32 may also be determined in relation to the position of the discrete article guiding passages 26, among other possibilities. As described above, the suitable position for the container engaging device 32 is a position in which the container engaging device 32 can adequately support and stabilize the given size and shape of containers 30 being filled.

The information that is input by a user may take on a variety of different forms.

In accordance with a first non-limiting example, the information input by a user may be a user's selection of a pre-set position from a plurality of pre-set positions for the container engaging device 32. For example, three pre-set positions may be proposed to the user via the display 84 of the user interface, such as a first position for small containers, a second position for medium containers and a third position for large containers. These pre-set positions may be stored in the memory 66 of the control entity 60, such that they can be accessed by the processing entity 64 and displayed to a user via the user interface 76 so as to obtain the user's selection. Each of these pre-set positions may be associated with an encoder position for the servo motor 54, such that the servo motor 54 can acquire the exact position associated with the stored encoder position. Alternatively, the pre-set positions may be associated with pre-established coordinates of a reference system used by the positioning assembly 48 to position the container engaging device 32, such that when a selection is made by a user, the container engaging device 32 is caused to acquire the position corresponding to those pre-established coordinates. It should be understood that any number of pre-set positions may be stored within the memory 66 of the control entity 60 for display to a user. These pre-set positions may be based on the size of the container, as described above, or based on a name of a discrete article, a serial number of a container, or any other way of providing different options for a user for positioning the container engaging device 32.

In accordance with a second non-limiting example, the information input by a user may be indicative of a characteristic of the containers 30 to be filled, or a characteristic of the discrete articles that will fill the containers 30. Examples of possible characteristics that could be entered by the user include a diameter of the containers 30, a height of the containers 30, a volume of the containers 30, a name of the containers 30, a bar code for the containers 30 or a serial number associated with the type of container. In the case where the discrete articles are pharmaceutical pills, the size of the container could be determined from characteristics of the discrete articles such as the name of the discrete article, the size of the discrete article or the chemical compound of the discrete article that will fill the containers 30.

In accordance with yet a further non-limiting example, the information input by a user may comprise directional signals from a joystick or other direction-indicating user input, such as an "up" button and/or a "down" button, among other possibilities. In order to input a signal, a user may operate one or more of the user operable inputs 78 in order to provide a signal to the control entity 60 indicative that the direction the container engaging device 32 should be moved, such as "up" or "down", or "back" or "forward". This may be done by pushing a joystick into an "up" position for providing a signal indicative that the container engaging device 32 should move upwards such that it is higher in relation to the transporting path 34. Similarly, a user may operate one or more of the user operable inputs 78 in order to provide a signal to the control entity 60 indicative that the container engaging device 32 should move backwards from proximity to the transporting path 34. So long as the user is activating a "backwards" user operable input, which may be pushing a joystick to the left, the control entity 60 will continue to receive a signal indicative that the container engaging device 32 should be moved back in a lateral direction from the transporting path 34.

Therefore, in any of the manners described above, a user may interact with the user interface 76 in order to input information on the basis of which a suitable position for the container engaging device 32 can be determined.

As mentioned above, at step 90, the control entity 60 receives input information via the user interface 76, on a basis of which a suitable position for the container engaging device 32 in relation to the transporting path 34 can be determined. This input information is received at the input 62, and is then passed to the processing entity 64, such that the processing entity 64 can then determine a suitable position for the container engaging device 32.

At step 92, the processing entity 64 determines, at least in part on a basis of the input information received from a user, a suitable position for the container engaging device 32 in relation to the transporting path 34 and/or the discrete article guiding passages 26. The suitable height for the container engaging device 32 is generally determined in relation to the discrete article guiding passages 26 more then the transporting path 34. The determination of the position of the container engaging device 32 may be done in a variety of manners depending on the nature of the input information received from the user.

For example, in the case where the input information is a user-selected one of a plurality of pre-set positions that were displayed to the user, the determining may involve performing a look-up function in the data 68 contained in the memory 66. This data 68 may include a database that lists the names or codes of the pre-set positions, and associates with each of these names either, encoder positions for the servo motor 54, position coordinates of a reference system that is used by the positioning assembly 48 or positions for the threaded rods 50, 52 (or other mechanical components). Therefore, in the case where the input information is a user's selection of a pre-set position, the processing entity 64 may access the database and look up an entry that matches the user's selection. Once the processing entity 64 has found the entry in the database that matches the user selection, the processing entity 64 would then determine the encoder position (or encoder "recipe"), the position coordinates or the mechanical component settings that are contained in the entry that matches the user selection.

In the case where the input information is indicative of a characteristic of the containers 30 or a characteristic of the discrete articles that will fill the containers 30, the determining may involve performing a look-up function in the data 68 stored in the memory 66. For example, the data 68 may include a database that lists a plurality of different characteristics for the containers 30 and/or the discrete articles, and associates with each of these characteristics, an appropriate encoder position for the servo motor 54, position coordinates or mechanical component settings for the threaded rods 50, 52 (or other mechanical components that affect the change in position). Therefore, when a user enters information indicative of a characteristic of the containers 30 or the discrete articles, the processing entity 64 may access the database within the memory 66 and look for an entry that matches the characteristic entered by the user. Once the processing entity 64 has found the entry in the database that matches the user-entered characteristic, the processing entity 64 can then determine the encoder position, position coordinates or the component settings that are contained in the entry that match the user-entered characteristic.

Alternatively, in the case where the input information is indicative of a characteristic of the containers 30 or a characteristic of the discrete articles that will fill the containers 30, the determining may involve executing a pre-established algorithm. The algorithm may be stored within the program instructions 70 of the memory 66. The algorithm may be executed at least in part on a basis of the information input by the user indicative of a characteristic of the containers 30. For example, in the case where the characteristic of the container 30 is a diameter or volume of the containers 30, the processing entity 64 may access the pre-established algorithm stored in the memory 66, for applying the user-entered diameter or volume into the pre-established algorithm. By running the algorithm at least in part on a basis of the entered characteristics (such as diameter or volume), the output of the algorithm will provide a suitable position for the container engaging device 32 in relation to the discrete article guiding passages 26. In this manner, the memory 66 does not need to store a database listing container characteristics, for containers that could be processed by the container filling machine 10.

However, in the case where one or more databases are used to associate the characteristics of the containers 30 and/or discrete articles with a suitable position for the container engaging device 32, these databases may be provided by a manufacturer of the container filling machine 10, or may be slowly built by a user of the container filling machine over time. For example, the first time the container filling machine 10 has to handle a new type of container 30, the machine operator may manually adjust the positioning of the container engaging device 32, such that the container engaging device 32 is in a suitable position for stabilizing that new type of container 30. The operator may then cause a record to be stored in the memory 66 associating the new container 30 with the suitable position. This may involve causing a record to be stored that associates the container name, a pre-set position name, or a characteristic of the container with the encoder position for the servo motor 54 (the encoder "recipe"), the mechanical component positions or the positions for some other coordinate system. As such, the next time the container filling machine 10 has to handle this new type of container 30, the user can simply access the stored record for causing the container engaging device 32 to acquire the pre-established suitable position. As such, each time a user has manually and/or through trial-and-error established a suitable position for the container engaging device 32 when handling a given type of container 30, the user may save a record within the memory 66 in order to store in connection with one or more characteristics of the container (such as its diameter, height, volume and/or serial number) an associated position for the container engaging device 32, which could be an encoder recipe, among other possibilities.

In the case where the information input by a user is a signal indicative of a direction for the movement of the container engaging device 32, the determining may involve receiving the signal and interpreting the signal to determine the direction the container engaging device 32 should be moved.

Once a suitable position for the container engaging device 32 has been determined, at step 94, the processing entity 64 is operative for causing the container engaging device 32 to acquire the suitable position. This may be done by issuing one or more control signals to the servo motor 54 for causing the servo motor 54 to acquire the appropriate encoder position, or for causing the servo motor 54 to otherwise control the positioning assembly 48, for moving the container engaging device 32 up or down, or back and forth until the container engaging device 32 has acquired the suitable position in relation to the transporting path 34 and/or the discrete article guiding passages 26.

Ii) Controlling Movement of the Container Engaging Device 32 on a Basis of Information Received from One or More Sensors.

In accordance with a second non-limiting example of implementation, the control entity 60 is operative for controlling the movement of the container engaging device 32 at least in part on a basis of information received from at least one sensor included within sensors 72. A The sensors 72, which may include one or more sensors for different purposes, may include an optical sensor, a bar-code reader or a scale that is operative for obtaining information on a basis of which a suitable position for the container engaging device 32 can be determined. This information on a basis of which a suitable position for the container engaging device 32 can be determined may be a reading of a characteristic of the containers 30, among other possibilities. The one or more sensors 72 may be positioned at any suitable location for obtaining such information, such as at a region where the containers approach the container filling machine 10. The sensors 72 may be positioned at any location along the production line prior to the container filling machine 10, so long as at least one sensor 72 is able to obtain a reading of a characteristic of the containers 30. The at least one sensor 72 may be an optical sensor that is able to detect the height and/or diameter of the container at a location where the containers 30 are put into the production line. Or alternatively, the at least one sensor 72 may be a bar code reader that is able to read a bar code of the containers 30 after a label has been applied to the container. Alternatively, a capacitive sensor may be incorporated into the container filling machine 10 for obtaining readings of characteristics (such as size and volume) of the discrete articles that will fill the containers 30. It should be understood that the examples provided above are given purely for the sake of illustration and should not be used to limit the scope of the present invention.

Different types of sensors 72 that are operative for obtaining readings of one or more characteristics of the containers 30, or the discrete articles that will fill the containers 30, are known in the art, and would be understood to a person of skill in the art. Any sensor 72 that is operative for obtaining a reading of a characteristic of the containers 30, or any other information on a basis of which a suitable position for the container engaging device 32 can be determined, is included within the present invention.

The sensor readings are passed from the sensors 72 to the input 62 of the control entity 60, which are in turn passed to the processing entity 64. The processing entity 64 is then operative for processing this input information in the same manner as described above with respect to steps 92 and 94, for determining a suitable position for the container engaging device 32 in relation to the transporting path 34 and/or in relation to the discrete article guiding passages 26.

Discrete Article Guiding Passages 26 in Communication with a Suction Pump 80

Referring back to FIG. 2, the container filling machine 10 according to a non-limiting example of implementation of the present invention comprises discrete article guiding passages 26 for guiding/dispensing the discrete articles into the containers 30 that are to be filled. Each of the discrete article guiding passages 26 comprises a passageway that defines a length "l" through which discrete articles pass prior to entering the containers 30. As shown in FIG. 1, the containers 30 are positioned beneath an exit-end 86 of the discrete article guiding passages 26, such that discrete articles are dispensed out of the exit-end of the discrete article guiding passages 26 before entering the containers 30.

The length "l" of the passageways extends from the entry ends 88 of the discrete article guiding passages 26 to the exit-ends 86 of the discrete article guiding passages 26. In the non-limiting embodiment shown, the passageways form generally cone-shaped tubes such that the entry ends 88 are wider than the exit-ends 86. In this manner, the discrete article guiding passages 26 are able to receive discrete articles from a plurality of guiding paths 16 and funnel these discrete articles into the relatively narrow openings of the containers 30. It should, however, be appreciated that the discrete article guiding passages 26 could be in the form of different shapes, such as cylinders having an even diameter along the length of the passageway, or triangular or rectangular funnel shapes, among other possibilities. In addition, the length "l" of the passageways can vary, and a person of skill in the art would be able to determine an appropriate length "l" for the discrete article guiding passages 26 depending on the nature of the container filling machine 10.

Figure 6:
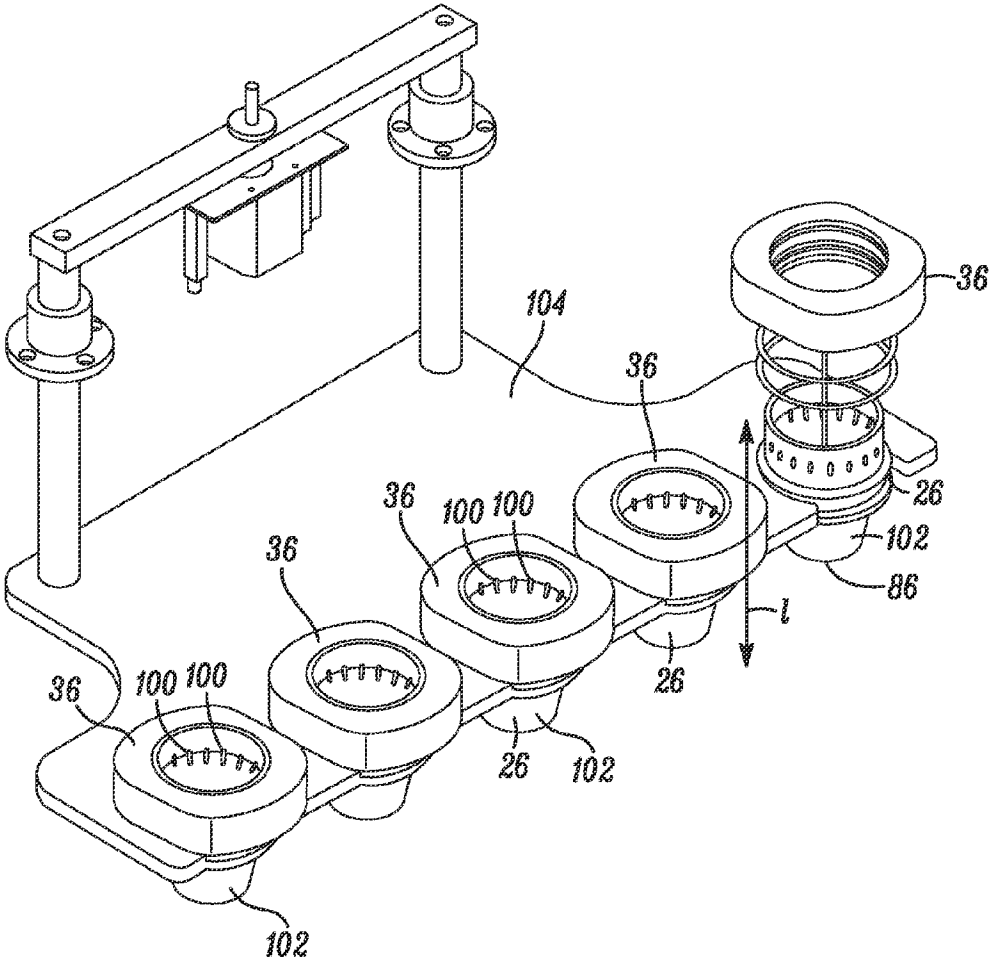
FIG. 6 shows a side perspective view of a portion of the discrete article guiding passages according to a non-limiting example of implementation of the present invention, with one of the discrete article guiding passages shown in an exploded view.

Shown in FIG. 6 is a perspective view of a bottom portion of the discrete article guiding passages 26, with one of the discrete article guiding passages 26 shown in an exploded state. In the embodiment shown, each of the discrete article guiding passages 26 comprises a collar 36 positioned approximately mid-way along the length "l" of the passageway. It should be appreciated that in other embodiments, the collar 36 could be positioned at any region along the length "l" of the discrete article guiding passages 26. For example, the collar 36 may be positioned around the top of the passageway at the entry-end 88 to the discrete article guiding passages 26.

Furthermore, each of the discrete article guiding passages 26 comprises a plurality of suction apertures 100 positioned at a region along the length "l" of the passageway. As will be explained in more detail below, the suction apertures 100 are adapted for receiving fine airborne particles via a suction effect so as to prevent these airborne particles from accumulating within the parts of the container filling machine 10. The collar 36 is adapted for forming a type of housing around the plurality of suction apertures 100, such that the fine airborne particles that enter the suction apertures 100 are contained by this housing before being suctioned into a proper disposal tank.

As best shown in FIG. 2, the discrete article guiding passages 26 in the non-limiting example of implementation shown are formed by a lower portion 102 and an upper portion 106. The lower portion 102 is adapted for being received within a supporting plate 104 that holds the lower portions 102 above the container transporting path 34. The plurality of suction apertures 100 are formed into an upper rim of the lower portion 102, and the collar 36 is then positioned over this upper rim for forming a housing around the plurality of apertures 100. The upper portion 106 of the discrete article guiding passages 26 are then positioned in communication with the lower portion 102 and/or the collar 36. In an alternative embodiment, the upper portion 106 may not be part of the discrete article guiding passages 26, in which case the discrete article guiding passages 26 are formed only from the lower portion 102 shown in FIG. 6 and the collar 36. Although the collar 36 is shown as a separate component in FIG. 6, it is possible for the housing around the suction apertures 100 to be integrally formed with the lower portion 102 of the discrete article guiding passages 26.

Furthermore, although in the non-limiting embodiment shown in FIG. 6 a plurality of suction apertures 100 are depicted, it should be appreciated that each of the discrete article guiding passages 26 may include any number of suction apertures 100, without departing from the present invention. For example, only one suction aperture in the form of an annular gap between the lower portion 102 of the discrete article guiding passage 26 and the collar 36 or upper portion 106, may be possible. Any number of suction apertures 100, having any size and shape (although preferably smaller than the discrete articles that are filling the containers), may be included within each of the discrete article guiding passages 26, without departing from the present invention. Furthermore, although the plurality of suction apertures 100 are shown in FIG. 6 as being located at a single horizontal location along the length "l" of the discrete article guiding passages 26, the plurality of suction apertures 100 may be located at different horizontal locations along the length "l" of the discrete article guiding passages 26. For example, the suction apertures 100 may be staggered in a zig-zag pattern along the length "l" of the passageway. In addition, the plurality of apertures 100 may extend straight through the wall of the passageway, or alternatively may extend through the wall of the passageway at an angle. For example, the plurality of apertures 100 may be angled downwards from the outside-in for better receiving dust that is moving up the passageways of the discrete article guiding passages guiding passages 26.

In the non-limiting embodiment shown in FIG. 6, the suction apertures 100 are spaced evenly around a periphery of each of the discrete article guiding passages 26. However, in an alternate embodiment, the suction apertures 100 may be positioned randomly, or in an uneven manner, around the periphery of the discrete article guiding passages 26.

Figure 7:
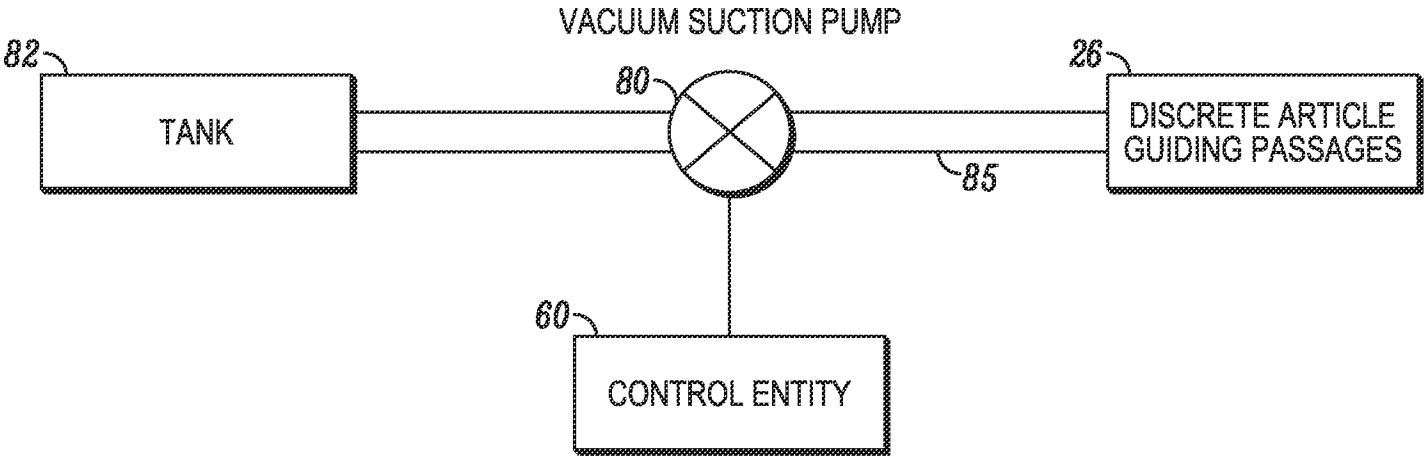
FIG. 7 shows a block diagram of a non-limiting example of a suction device comprising the discrete article guiding passages of FIG. 6 and a vacuum suction pump.

As described above, the suction apertures 100 are included within the discrete article guiding passages 26 in order to receive dust and fine airborne particles under a suction effect. As shown in FIG. 7, the discrete article guiding passages 26 are in communication with a vacuum suction pump 80 that is operative for creating the suction effect through the suction apertures 100. More specifically, and although not shown in FIG. 6, connected to the collars 36 are suction conduits 85 that are in communication with the vacuum suction pump 80, such that when the vacuum suction pump 80 is activated, a low pressure region is created in the region between the collar 36 and the suction apertures 100. As such, any fine airborne particles that are located within the passageway of the discrete article guiding passages 26 are sucked into the suction apertures 100 and enter the region between the collar 36 and the suction apertures 100. These fine airborne particles are then further sucked into the suction conduits 85 so that they ultimately end up in a disposal tank 82, such as a vacuum bag.

The combination of the discrete article guiding passages 26 that comprise the plurality of suction apertures 100 and the vacuum suction pump 80 can be considered a suction device that is used with the container filling machine 10 for removing fine airborne particles that are created. This helps to avoid frequent maintenance of the container filling machine 10 due to an excess of dust that has accumulated within the parts of the machine 10.

The vacuum suction pump 80 may be any suitable suction pump known in the industry. A person of skill in the art would be able to select a vacuum suction pump that is suitable for creating a sufficient suction effect within the passageways of the discrete article guiding passages 26 for receiving the airborne particles. A non-limiting example of a suitable suction pump is a Busch vacuum pump having a suction rate of 250 $m^3$/hour.

Referring back to FIG. 4, in accordance with a non-limiting example of implementation of the present invention, the suction pump 80 is under the control of the control entity 60. Although it is control entity 60 that is described herein as being operative for controlling the activation of the suction pump 80, it should be understood that in an alternative embodiment, a separate control entity that is dedicated to the control of the suction pump 80 could also be used.

The suction pump 80 may be caused to be actuated upon receipt of an activation signal from the control entity 60. This activation signal may be sent to the suction pump 80 upon start-up of the container filling machine 10, such that while the container filling machine 10 is in operation, the suction pump 80 is also in operation. Alternatively, the control entity 60 may cause the suction pump 80 to be activated intermittently. For example, the control entity 60 may cause the suction pump 80 to be activated for one minute every five minutes, or the control entity 60 may cause the suction pump 80 to be activated for a half hour, every hour, among other possible examples.

The control entity 60 may control the suction pump 80 according to a variety of different program instruction 70, which may be selected depending on the type of discrete article being processed. For example, given that pressed powder pills will generate more dust than gel-cap pills, a user of the container filling machine 10 may instruct the control entity 60 to control the suction pump 80 according to one set of program instructions if the container filling machine 10 is processing gel-cap pill, and a different set of program instruction if the container filing machine 10 is processing pressed powder pills. In the case of the gel-cap pills that don't generate much dust, the suction pump 80 may be caused to be activated for only one minute every 10 minutes, for example, while in the case of pressed powder pills that generate more dust, the suction pump 80 may be caused to be activated for one minute every 2 minutes. The program instructions 70 used by the control entity 60 to control the suction pump 80 may be stored in the memory 66, as shown in FIG. 4, and the user may instruct the control entity 60 which program instructions to use via the user interface 76.

In a further alternative embodiment, the control entity 60 may control the activation of the suction pump 80 at least in part on a basis of information received from a sensor included within the sensors 72. For example, a sensor for detecting the level of airborne particles may be included within one or more of the discrete article guiding passages 26, such that upon detection of a level of airborne particles that exceeds a pre-determined level, the control entity 60 may cause the suction pump 80 to be activated for a given period of time, or until the sensors 72 detect that an acceptable level of airborne particles has been reached. In this manner, the suction pump 80 would only be activated when necessary in order to avoid draining battery power and in order to reduce noise.

Different types of sensors that are operative for obtaining readings of airborne particles are known in the art, and would be understood by a person of skill in the art. Any sensor that is operative for obtaining a reading of a level of airborne particles is included within the sensors 72 of the present invention.

As mentioned above, once activated, the suction pump 80 is able to create a suction effect within the passageways of the discrete article guiding passages 26, such that airborne particles can be sucked into the suction apertures 100. In this manner, fine airborne particles, such as dust particles generated by the discrete articles, are suctioned out of the discrete article guiding passages 26 and thus prevented from accumulating within the parts of the container filling machine 10.

Container Removing Device 38

Sometimes, a container 30 that is being filled by the container filling machine 10 is defective or deficient in some way. A filled container 30 can be considered defective or deficient for a variety of reasons, such as when it is filled with an incorrect number of discrete articles, when it contains a defective discrete article, when its sealing cap has been applied either too tight or too loose, or when the container is physically damaged in some way. Regardless of the reason that a container is defective or deficient, it is desirable to be able to remove the defective container from continued travel along the production line.

Figure 8:
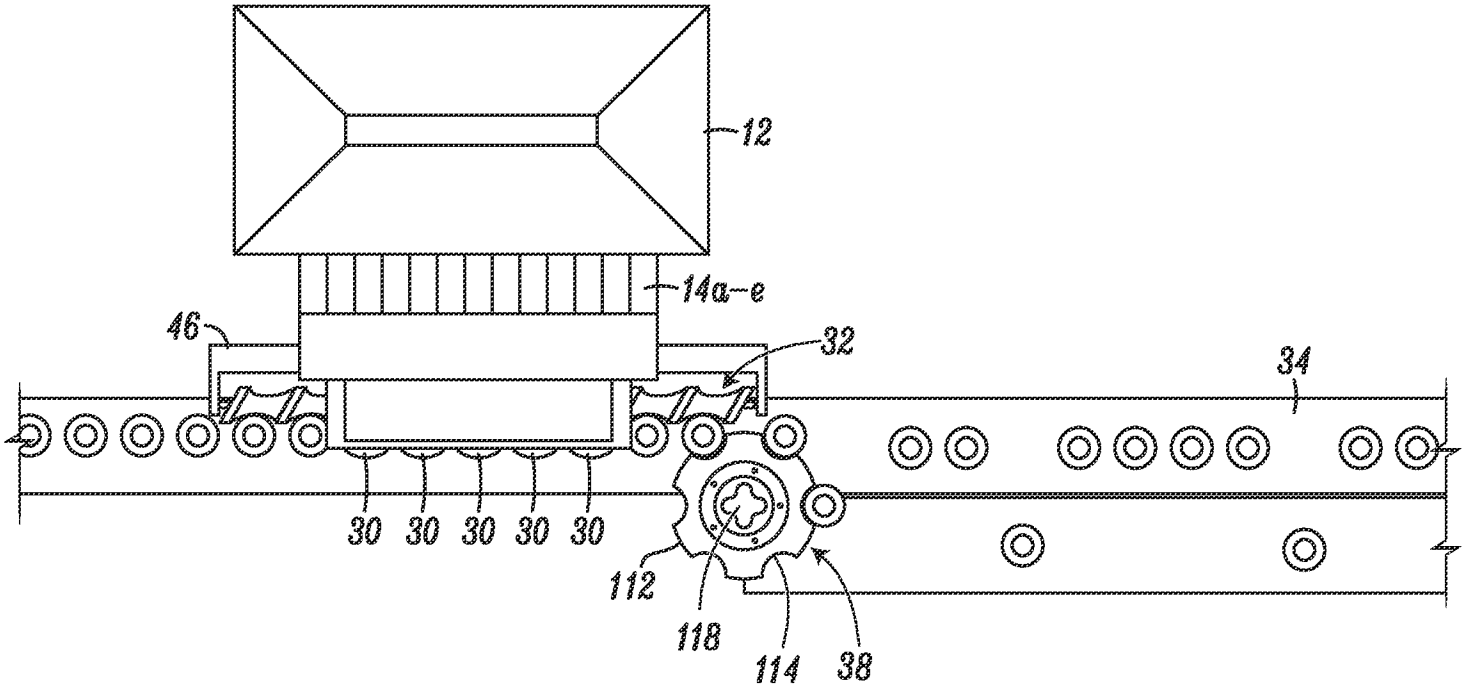
FIG. 8 shows a top plan view of a non-limiting example of a positioning of the container filling machine and the container removing device in relation to a container transporting path.
Figure 9:
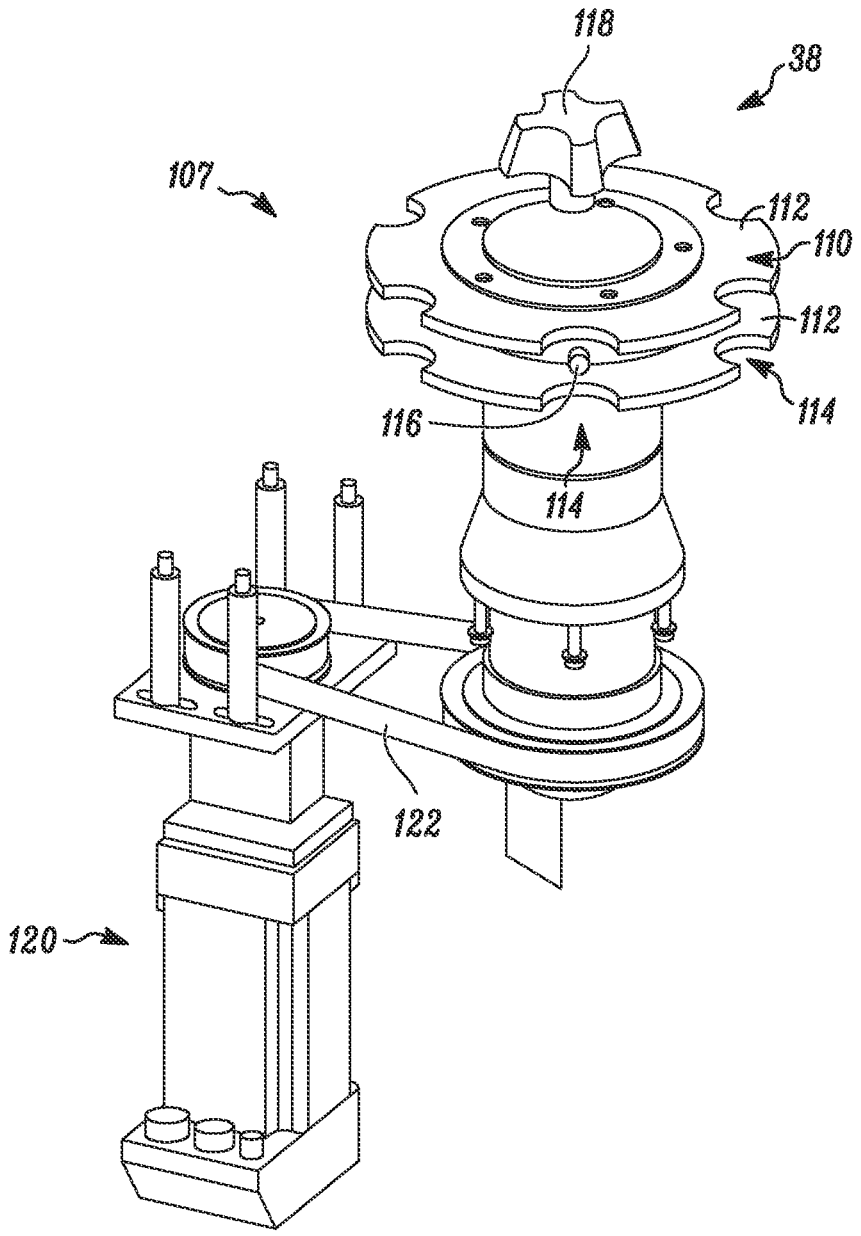
FIG. 9 shows an isolated side perspective view of the container removing device according to a non-limiting example of implementation of the present invention.

As shown in FIGS. 2, 8 and 9, the container filling machine 10 according to the present invention comprises a container removing device 38 that is operative for removing defective or deficient containers 30 from continued travel along the production line. In this manner, defective containers 30 can be removed from the production line in an automated manner in order to improve efficiency and quality control.

Shown in FIG. 9 is a container removing assembly 107 that comprises the container removing device 38 and a drive mechanism that includes an electric motor 120 (which can be a servo motor) and a drive belt 122. The electric motor 120 and drive belt 122 are able to impart rotational motion to the container removing device 38, such that the container removing device 38 can move the defective containers from the production line to a region away from the production line. As shown, the container removing device 38 comprises a carousel shaped body 110 that is defined by two spaced-apart circular plates 112 defining a plurality of container engaging recesses 114. It should be appreciated that the container engaging recesses 114 can be of any shape that is suitable for engaging the shape/profile of the containers 30 being filled. Between the two spaced-apart circular plates 112 is a body portion that houses a plurality of suction conduits 116 that extend into the body portion. Each of the suction conduits 116 is in communication between a vacuum suction pump (not shown) and the container engaging recesses 114 such that when the suction pump is activated, the suction conduits 116 create a suction effect in the vicinity of the container engaging recesses 114. In this manner, the container removing device 38 is able to establish suction engagement with defective containers 30. More specifically, a defective container 30 is able to be received within one of the container engaging recesses 114 and held in place via the suction effect created by the suction conduit 116 and the suction pump (not shown).

In the embodiment shown, the container removing device 38 comprises six container engaging recesses 114. However, depending on the diameter of the container removing device 38, more or fewer container engaging recesses 114 could be included. Furthermore, although the carousel-shaped body 110 of the container removing device 38 is formed of two spaced-apart plates 112 with a body portion in between, the carousel-shaped body 110 could be a single integral piece that is molded into the desired shape, or can be formed of any number of pieces that are connected in any known manner.

The carousel shaped body 110, including the plates 112 and the body portion in between, can be made of any suitable material, such as stainless steel, aluminum, polyurethane, etc.

As shown in FIG. 9, the carousel shaped body 110 of the container removing device 38 is operative for rotating about its central axis 118. When the electric motor 120 is activated, the drive belt 122 is caused to rotate, which in turn imparts rotational motion to the carousel-shaped body 110 of the container removing device 38. As will be described in more detail below, this rotation allows the container removing device 38 to carry a defective container 30 from a first position (generally the transportation path 34 of the production line) to a second, drop-off, position (away from the production line) where the defective container 30 is released from the container removing device 38.

FIG. 8 shows a top plan view of the container filling machine 10 and the container removing device 38 according to a non-limiting example of implementation of the present invention. The container removing device 38 is positioned on the opposite side of the container transporting path 34 from the container filling machine 10. The container removing device 38 is also positioned between the container transporting path 34 of the production line and a rejection transporting surface 124 that leads to a discarding station. In the embodiment shown, the rejection transporting surface 124 is a conveyor belt that runs parallel to the transporting path 34.

As shown in FIG. 8, the container removing device 38 is located in the vicinity of the feed screw 40 of the container engaging device 32. More specifically, the container removing device 38 is positioned on the opposite side of the transporting path 34 from the feed screw 40, such that it is positioned substantially across from the last pocket or indent of the feed screw 40. In this manner, for a portion of its travel along the transporting path 34, a container 30 will be in contact with both the feed screw 40 and a container engaging recess 114 of the container removing device 32. In this manner, the container removing device 38 is able to engage with a defective container 30 before the defective container leaves the feed screw 40. This better creates a positive reject station that can more accurately control the removal of defective containers 30, as the timing and indexing between detecting a defective container 30 and removing the defective container 30 is reduced.

Once the container removing device 30 has established suction engagement with a defective container 30, the defective container 30 does not continue its travel along the transporting path 34 of the production line, and is instead almost instantly removed by the container removing device 38. In operation, the container rejection device 38 turns in synchronization with the rotation of the feed screw 40, such that the feed screw 40 indexes the rotation of the container rejection device 38. When it is necessary to remove a container 30 from continued travel along the transporting path 34, a suction effect in the vicinity of the given container engaging recess 114 that is in communication with the defective container is activated, as will be described in more detail below.

Although a rejection transporting surface 124 is shown in the Figures, it is possible that the container removing device 38 carries a defective container 30 directly to a discarding station, which may be a disposal bin, or a station that empties the defective container 30 of its contents and puts the container back into circulation to be filled again. The positioning of the container removing device 38 between the container transporting path 34 and the rejection transporting surface 124 allows the container removing device 38 to engage defective containers 30 travelling along the transporting path 34 of the production line and transport them to the rejection transporting surface 124, via the rotation of the carousel-shaped body 110.

The container removing device 38 is indexed with the rotation of the container engaging device 32, such that when a defective container 30 is detected, it passes through one of the container engaging recess 114 of the container removing device 38 before being moving past the feed screw 40 for further travel along the transporting path 34. Because the defective container 30 passes through, and is in contact with one of the container engaging recesses 114 while it is still in contact with the feed screw 40, it is easy for the container removing device 38 to establish suction engagement with the defective container 30. When a suction effect is created in the vicinity of the container engaging recess 114, the defective container is engaged and held by that container engaging recess 114. The carousel-shaped body 110 of the container removing device 38 then continues to rotate such that the defective container 30 is carried from the container transporting path 34 to the rejection path 124. In the embodiment shown, the container removing device 38 rotates by at about 90 degrees in order to be able to carry a defective container 30 from the transporting path 34 to the rejection path 124. However, any amount of rotation is possible within the present invention. Once the defective container 30 has been transported to the rejection path 124, the suction effect (not shown) is deactivated such that the defective container 30 can be released from the container removing device 30 and deposited onto the rejection path 124.

The suction effect that is provided to the container engaging recesses 114 may be controlled in a variety of manners. For example, the suction pump may be in direct communication with each of the suction conduits 116 such that when the pump is activated, a suction effect is created at all the container engaging recesses 114, and when the suction pump is deactivated, the suction effect is stopped at all of the container engaging recesses 114.

In an alternative, more likely, example of implementation, included between the suction pump and the termination of each suction conduit 116 at a respective container engaging recess 114, is a valve (not shown). As such, the suction pump can be continually in operation and the suction effect at a given one of the container engaging recesses 114 can be controlled by controlling whether or not its associated valve is open or closed. In this manner, a defective container 30 travelling along the transporting path 34 can be picked up by the container removing device 38 by opening the valve associated with the container engaging recess 114 that is in proximity to that defective container 30, while at the same time, a defective container being held under suction engagement by another one of the container engaging recesses 114 can be released onto the rejection path 34 by closing the valve associated with that container engaging recess 114. This allows the container moving device 38 to better handle multiple containers at the same time.

Although the container transporting path 34 is shown as being a continuous conveyor belt, in practice this transporting path 34 could be made of a plurality of conveyor belts positioned one after the other, such that different sections of the container transporting path 34 can be controlled independently.

In operation, the container removing device 38 can be mounted to a support structure positioned beneath both the container transporting path 34 and the rejection transporting surface 124. This can be done via mechanical fasteners such as bolts, screws and rivets, among other possibilities. Any manner of mounting the container removing device 38 in proximity to the container transporting path 34, such that it is able to be in communication with both the electric motor 120 and a suction pump (not shown) is included within the present invention.

The control of the container removing device 38 will now be described in more detail with respect to the block diagram of FIG. 4 and the flow diagram of FIG. 10.

In the non-limiting embodiment shown in FIG. 4, the container removing device 38 is in communication with control entity 60 such that the control entity 60 is operative to control the functionality of the container removing device 38. However, it should be understood that in an alternative embodiment, the container removing device 38 may be in communication with a different control entity that is dedicated to controlling only the functionality of the container removing device 38. Regardless of whether the functionality of the container removing device is controlled by control entity 60 (that controls the functionality of multiple components) or a dedicated control entity, the control entity may be an integral part of the container filling machine 10, or may be a portable device such as a laptop, or desktop computer that is connected via cables to the container removing device 38 (and possibly other components). In yet a further alternative embodiment, the control entity may be implemented within a portable wireless device, such as a smart phone, such that it is in communication with the various components over wireless RF or cellular connections. In yet a further example of implementation, the control entity may be implemented at a remote server, such that it is in communication with the container removing device 38 over network connections, via the internet, or a local intranet, for example.

For the sake of simplicity, the container removing device 38 will be described herein as being in communication with control entity 60, however, it should be understood that wherever control entity 60 is described, the same functionality could also be implemented by a different, dedicated control entity 60.

In accordance with the present invention, the control entity 60 is further in communication with sensors 72, such that the control entity 60 can control the operation of the container removing device 38 at least in part on a basis of information received from at least one sensor included within sensors 72. In this manner, the functioning of the container removing device 38 is substantially automated, such that defective containers 30 are removed from continued travel along the production line without the need for extensive human input.

The sensors 72 may comprise one or more sensors that are suitable for detecting a defective container. For example, the sensors 72 may include one or more weight sensors positioned beneath the container transporting path 34 at locations beneath each of the discrete article guiding passages 26 that dispense the discrete articles into the containers 30. As such, these sensors may take weight readings of the containers 30 as the containers 30 are being filled. Alternatively, the weight sensors could be positioned at other locations prior to the container removing device 38 that allows them to obtain weight readings of the filled containers. Such weight measurements will enable the determination of whether the containers 30 have been filled with an appropriate number of discrete articles, or whether there are too few or too many discrete articles within the containers 30. For example, in the case where the weight of one of the containers 30 is above or below a target weight, then it is possible for that container to be identified as being defective.

The sensors 72 may also comprise torque measuring sensors that are operative for detecting a level of torque applied to a container's cap. Although not shown in the Figures, a capping and torque reading station may be positioned prior to the container removing device 38, for obtaining a torque measurement of a container's sealing cap. A more detailed explanation of such sensors and measurement devices are included within co-pending U.S. patent application Ser. No. 12/342,923 and as such will not be described in more detail herein. As such, if the level of torque that has been applied to the cap is found to be too little or too high, the container can be identified as being defective.

The sensors 72 may also comprise optical sensors or cameras for detecting any damage to the body of the containers, or detecting a defective or incorrect discrete (wrong shape or color) article in the bottle. In the case where a dent or hole is detected in the body of a container, the container may be identified as being defective. A non limiting example of sensors for detecting a defective discrete articles is described in U.S. Pat. No. 7,956,623, and as such will not be described in more detail herein. In addition, the sensors 72 may comprise a counting device for counting the number of discrete articles that enter each container 30. As such, if the count indicates that an incorrect number of discrete articles has entered a container 30, that container 30 may be considered defective.

Referring back to FIG. 4, the control entity 60 comprises an input 62 for receiving information from the sensors 72 indicative of a characteristic of the containers 30. The control entity 60 then passes this information to the processing entity 64, which processes the information at least in part on a basis of the data 68 and program instruction 70 stored in the memory 66, for implementing the functionality that will be described in more detail below.

The method performed by the control entity 60 in order to implement the functionality of the container removing device 38 will now be described in more detail with respect to the flow chart of FIG. 10.

Figure 10:
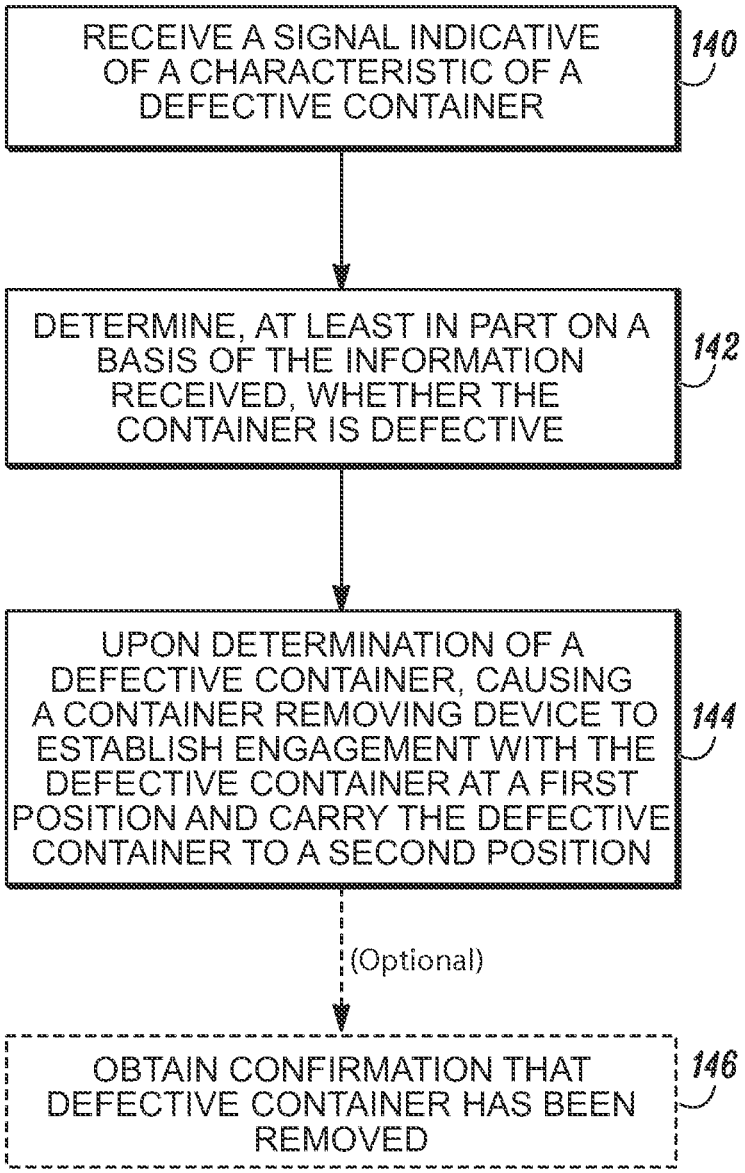
FIG. 10 shows a flow diagram of a non-limiting method of removing a defective container from continued travel along a production line after it has been filled with discrete articles by the container filling machine.

FIG. 10 shows a flow diagram of a non-limiting method of controlling the container removing device 38 in accordance with the present invention. At step 140, the control entity 60 receives information at input 62 from at least one sensor 72 indicative of a characteristic of one or more containers 30. It should be understood that the input 62 may receive information from one or more sensor 72 indicative of a characteristic of only a single container 30, or the input 62 may receive information from one or more sensors 72 indicative of a characteristic of a plurality of containers 30 simultaneously. For example, in the case where there are five weight sensors positioned underneath the five containers 30 that are being filled at a given time, the input 62 of the control entity 60 may receive information indicative of the filled weight of all five of the containers 30 simultaneously. In such a case, the information received from the sensors may comprise some sort of identifier, such as an ID number of the sensor, such that the control entity 60 is able to identify the container associated with each piece of received information.

As described above, the information indicative of a characteristic of a container 30 that is received at the input 62 of the control entity 60 may be indicative of a variety of types of information. For example, the information could be indicative of a weight of the container, a torque measurement associated with a sealing cap on the container, an optical or photographic image of the container, an incorrect discrete article count or any other information indicative of a characteristic of the container 30. Alternatively, in the case where the sensor has processing capability, the information indicative of a characteristic of the container 30 may be indicative that the container 30 is defective. For example, in the case where an optical scan detects a dent in the body of a container 30, instead of sending an image or optical coordinates to the control entity 60, the optical sensor may process that information in order to know that the container 30 is defective, and simply transmit a signal to the control entity 60 indicative that the container 30 is defective.

Once the information indicative of a characteristic of one or more containers 30 is received at the input 62, it is then passed to the processing entity 64. At step 142, the control entity 60 determines, at least in part on a basis of the information received from the at least one sensor, whether the container 30 is defective. More specifically, the processing entity 64 processes the information in order to determine whether the container 30 is defective. This determining may be done in a plurality of manners, and is usually performed at least in part on a basis of the data 68 and program instructions 70 stored in the memory 66.

In accordance with a first non-limiting example, the determining may be done on a basis of a look-up operation using a database stored in the memory 66. For example, in the case where the information received at the input 62 is indicative of a weight of the container 30, the processing entity 64 may look up that weight in a database that contains an entry for a plurality of possible weights, wherein each entry comprises a given weight and an indication as to whether that given weight is acceptable or unacceptable. The processing entity 64 therefore identifies the entry within the database that is associated with the measured weight received at input 62 and then identifies the "acceptable" or "unacceptable" condition corresponding to that weight within the entry.

In an alternative non-limiting example, the determining may be done via a comparison operation. In keeping with the example where the information received at the input 62 is indicative of a weight of the container 30, the processing entity 64 may access a comparison algorithm within the program instructions 70. The comparison algorithm may be operative for comparing the measured weight with an acceptable weight range that is stored within the data 68 of the memory 66. In the case where the measured weight is outside of the acceptable weight range, then the container 30 will be determined to be defective.

In yet a further non-limiting example, the determining may be done by applying the information indicative of a characteristic of the container 30 to an algorithm. For example, when the information received at the input 62 is indicative of a weight of the container 30, this measured weight may be applied to an algorithm that provides a response of either acceptable or defective. The algorithm may take into consideration other information, such as the height or volume of the container or the type of discrete article that has filled the container 30.

In the case where the information indicative of a characteristic of the container 30 is an indication that the container is defective, then the step 142 of determining that the container is defective may simply involve reading the signal indicative of this information.

Upon determination at the processing entity 64 that a container 30 is defective, at step 144, the control entity 60 causes the container removing device 38 to be activated for establishing engagement with the defective container 30 at a first position (namely a pick-up position along the transporting path 34 wherein the container 30 is still in contact with the feed screw 40) and carrying the defective container to a second position (drop-off position), wherein the defective container is removed from continued travel along the production line.

More specifically, there are two operations that need to occur in order to activate the container removing device 38. Firstly, the suction effect at a given container engaging recess 114 needs to be activated such that the container 30 that has been identified as being defective can be engaged by that container engaging recess 114. This can be done either by causing the activation of the suction pump (not shown) such that a suction effect is caused via the suction conduits 116 that extend between the suction pump and the container engaging recesses 114. Alternatively, in the case where the suction pump is continually active upon start up of the production line, the activation of the suction effect involves controlling a valve that is associated with the suction conduit 116 of a given container engaging recess 114 that is in proximity to the transporting path 34. In either case, the control entity 60 is operative for issuing one or more control signals for causing the suction effect to be activated. The signals may be issued to the suction pump for causing the suction pump to be activated, or the signals may be issued to a valve actuator for causing the valve to open.

Through activation of the suction effect at a given container engaging recess 114 (which is done either through activation of the suction pump or the opening of a valve for a suction conduit) the container removing device 38 is able to establish engagement with the defective container 30. As previously mentioned, engagement with the defective container 30 occurs at a first location, which is at a position where the defective container is on the container transporting path 34 of the production line.

Secondly, once the suction effect has been achieved, and the defective container 30 is in engagement with a container engaging recess 114 of the container removing device 38, the carousel-shaped body portion 110 of the container removing device 38 is then caused to rotate such that the defective container is carried from the container transporting path 34 to the rejection path 124. This rotational motion is imparted to the carousel-shaped body portion 110 by the electric motor 120 and the drive belt 122. However, other manners of imparting rotational motion to the container removing device 38 are also included within the scope of the present invention and would be known to a person of skill in the art.

In accordance with a non-limiting embodiment, the carousel-shaped body 110 is in continuous rotation at a desired rotation speed. When it is necessary to establish engagement with a defective container 30, the control entity 60 controls the activation of a suction effect in connection with a container engaging recess 114 as described above. In this manner, as the carousel-shaped body 110 turns, the container removing device is able to establish engagement with the defective container 30 through the activation of the suction effect at the container engaging recess 114 that is in closest proximity to the defective container 30. The carousel-shaped body 110 then continues to rotate such that the engaged defective container 30 is carried from the container transporting path 34 to the rejection path 124. After the container removing device 38 has rotated sufficiently to place the defective container 30 in position on the rejection path 124, the suction effect is deactivated such that the defective container 30 is released as the container removing device 38 continues its rotational motion.

In accordance with a non-limiting embodiment, one or more of the sensors 72 are provided for detecting whether the defective container has been released at the drop-off position on the rejection path 124. The one or more sensors 72 may include an optical sensor, such as a camera, that is able to determine whether a defective container is being carried by the appropriate container engaging recess 114 that was indexed to pick up the defective container from the feed screw 40, and whether the appropriate container engaging recess 114 then releases the defective container onto the rejection path 124.

Therefore, as shown in FIG. 10, in accordance with a non-limiting example of implementation, at step 146, the control entity 60 receives a signal from the sensor that provides confirmation that the defective container has been removed from continued travel along the production line. More specifically, the control entity 60 receives a signal from the one or more sensors 72 located in proximity to the rejection path 124 indicative that the defective container has been deposited on the rejection path 124. Alternatively, the one or more sensors may be weight sensors. Upon receipt of one or more signals indicative that the defective container 30 has been successfully removed from the transportation path 34 of the production line, the control entity 60 may provide an indication of successful removal to a user via the user interface 84, and/or the control entity 60 may store data regarding the removal of the defective container that can be compiled into statistical data later on.

In the case where the control entity 60 does not receive a signal confirming that a defective container 30 that has been identified by the control entity 60 has been released at the drop-off position onto the rejection path 124, then the control entity 60 may cause the container filling machine 10 to stop operation. This improves the quality control of the containers 30 being filled by the container filling machine 10.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A container-filling machine for filling a container with discrete articles, the container filling machine comprising:

a. a passageway through which discrete articles pass prior to being discharged into the container, the passageway being oriented such that discrete articles are transported through the passageway by gravity;

b. the passageway including a discharge aperture through which discrete articles exit the passageway to enter the container;

c. at least one suction aperture opening into the passageway at a location upstream the discharge aperture with relation to a direction of travel of the discrete articles into the passageway, the at least one suction aperture being operative to suck away airborne particles travelling into the passageway in a direction opposite the direction of travel of the discrete articles;

d. a sensor for counting discrete particles passing through the passageway.

2. A container-filling machine as defined in claim 1, wherein the passageway includes an end portion terminating with the discharge aperture, the end portion being free of a suction aperture.

3. A container-filling machine as defined in claim 2, wherein the end portion of the passageway has a cross-sectional dimension that progressively diminishes in a direction of travel of the discrete articles into the passageway.

4. A container-filling machine as defined in claim 3, wherein the at least one aperture is in communication with a vacuum suction pump for creating a suction effect within the passageway.

5. A container-filling machine as defined in claim 4, wherein the passageway includes a plurality of suction apertures.

6. A container-filling machine as defined in claim 5, wherein the plurality of suction apertures are evenly distributed around a periphery of the passageway.

7. A container-filling machine as defined in claim 6, wherein the end portion of the passageway is shaped as a truncated cone.

8. A container-filling machine as defined in claim 7, wherein the passageway comprises an entry end through which discrete articles are introduced into the passageway, the plurality of suction apertures being positioned closer to the discharge aperture than to the entry end.

* * * * *